US007931480B2

(12) United States Patent
Zhu

(10) Patent No.: US 7,931,480 B2
(45) Date of Patent: Apr. 26, 2011

(54) ELECTRICAL CONNECTOR WITH NEW TYPE OF CONTACTS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/768,646

(22) Filed: Apr. 27, 2010

(65) Prior Publication Data

US 2011/0065293 A1 Mar. 17, 2011

(30) Foreign Application Priority Data

Sep. 17, 2009 (CN) ..... 200920310583

(51) Int. Cl.
*H01R 12/00* (2006.01)

(52) U.S. Cl. ..... 439/78

(58) Field of Classification Search ..... 439/78–80, 439/83, 635–636, 59, 62
See application file for complete search history.

(56) References Cited

U.S. PATENT DOCUMENTS

| | | | | |
|---|---|---|---|---|
| 5,616,034 | A * | 4/1997 | Masuda et al. | 439/78 |
| 5,644,839 | A * | 7/1997 | Stone | 29/842 |
| 5,733,148 | A * | 3/1998 | Kaplan et al. | 439/680 |
| 6,832,934 | B1 * | 12/2004 | Zhang | 439/660 |
| 6,953,350 | B2 * | 10/2005 | Shiu | 439/79 |
| 2009/0035966 | A1 * | 2/2009 | Yuan et al. | 439/83 |
| 2010/0151709 | A1 * | 6/2010 | Busse | 439/78 |

* cited by examiner

*Primary Examiner* — Jean F Duverne
(74) *Attorney, Agent, or Firm* — Wei Te Chung; Andrew C. Cheng; Ming Chieh Chang

(57) ABSTRACT

An electrical connector includes an insulative housing; an upper row of contacts and a lower row of contacts parallel to each other. Each contact includes a retention portion, a mating portion and a pressing arm extending from two opposite ends of the retention portion. Each pressing arm includes a bending portion and a contact tail extending from an end of the contact tail. An imaginary central plane defined in the insulative housing about which the mating portions and the retention portions of contacts of the upper row and the lower row are symmetrical. Wherein each pressing arm includes a bending portion extending to the central plane and a pressing portion extending from the bending portion, the pressing portions are overlapped seen from a direction along which the contacts are arranged.

6 Claims, 4 Drawing Sheets

ELECTRICAL CONNECTOR WITH NEW TYPE OF CONTACTS

BACKGROUND OF THE INVENTION

1. Field of the Invention

The present invention relates to an electrical connector, and particularly to an electrical connector adapted for mounting on a print circuit board.

2. Description of the Related Art

With the rapid development of the technology of wireless communication and advanced technology of electrics, electrical connectors are designed to establish an electrical connection between a storage device and a print circuit board for high-speed signal transmission.

A kind of COMBO SATA connectors are widely used in modern industry which includes a plurality of signal contacts and jumper contacts, the jumper contacts are arranged into upper and lower layers, the upper jumper contacts are different from the lower jumper contacts in shape or form. That is to say, two kinds of mould should be essential during the manufacturing of the jumper contacts. Therefore, this design is adverse to save the total cost of manufacturing and simplify manufacturing process by reducing mould.

Hence, a new type of contact and manufacturing process are desired to overcome the disadvantages of the related art.

BRIEF SUMMARY OF THE INVENTION

Therefore, a main object of the present invention is to provide an electrical connector with a new type of contacts and manufacturing process.

To fulfill the above-mentioned object, an electrical connector, comprising: an insulative housing; an upper row of contacts and a lower row of contacts parallel to each other, each contact comprising a retention portion, a mating portion and a pressing arm extending from two opposite ends of the retention portion, each pressing arm comprising a bending portion and a contact tail extending from and end of the contact tail; an imaginary central plane defined in the insulative housing about which the mating portions and the retention portions of contacts of the upper row and the lower row are symmetrical; wherein each pressing arm comprise a bending portion extending to the central plane and a pressing extending from the bending portion, the pressing portions are overlapped seen from a direction along which the contacts are arranged Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
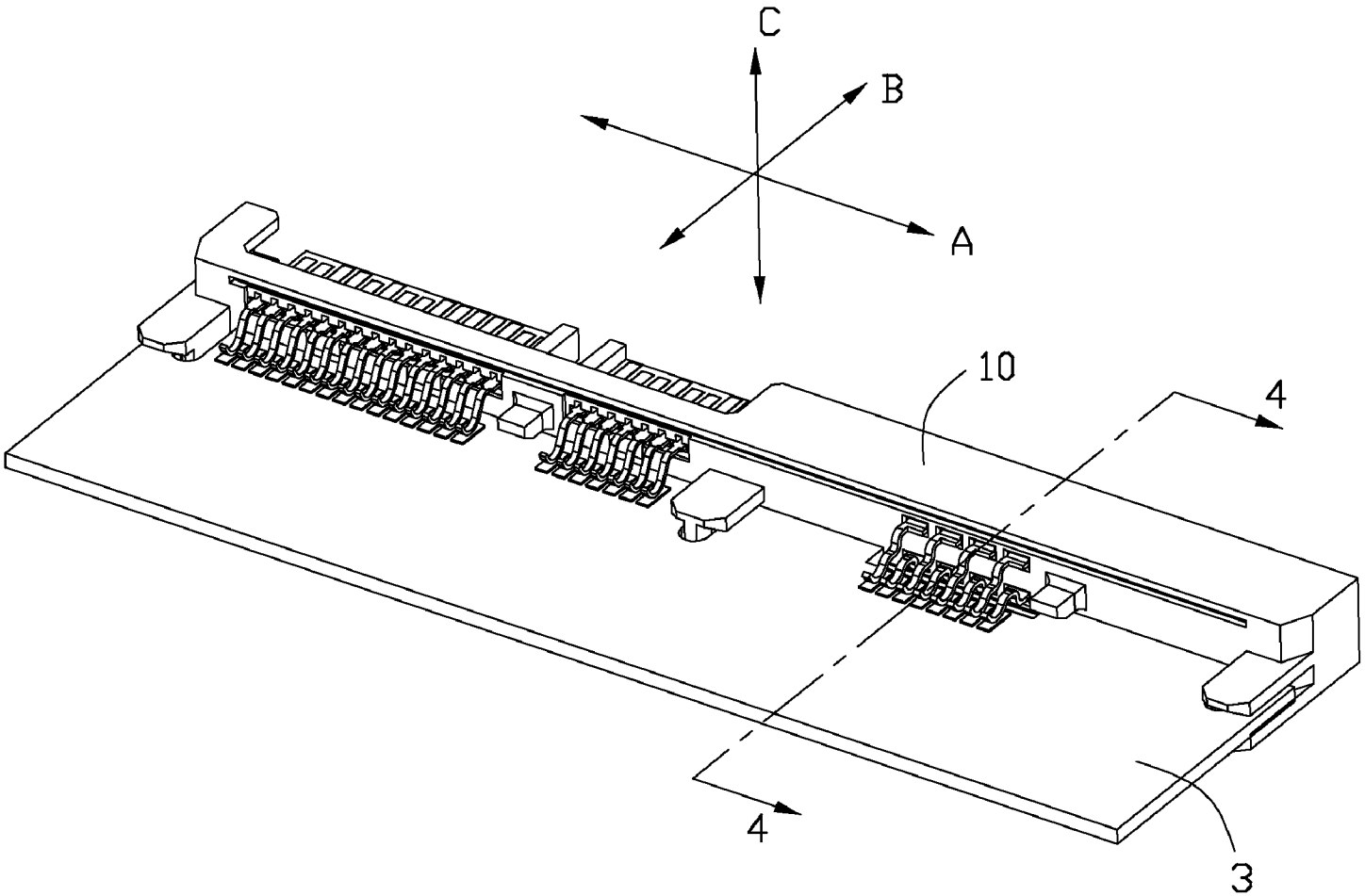
FIG. 1 is an assembled, perspective view of an electrical connector with a printed circuit board assembled therewith according to the present invention.
Figure 2:
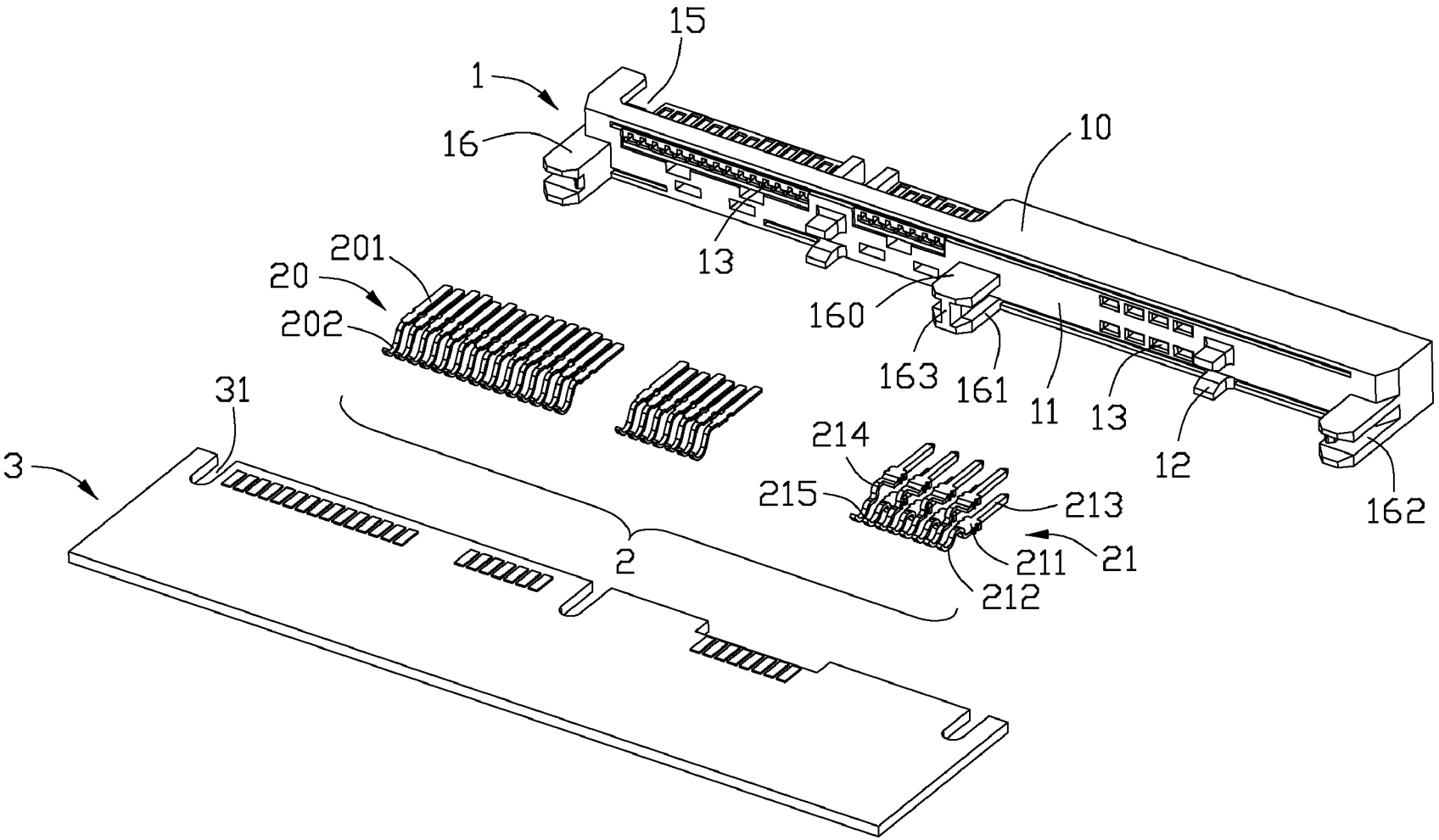
FIG. 2 is an exploded, perspective view of an electrical connector shown in FIG. 1.
Figure 3:
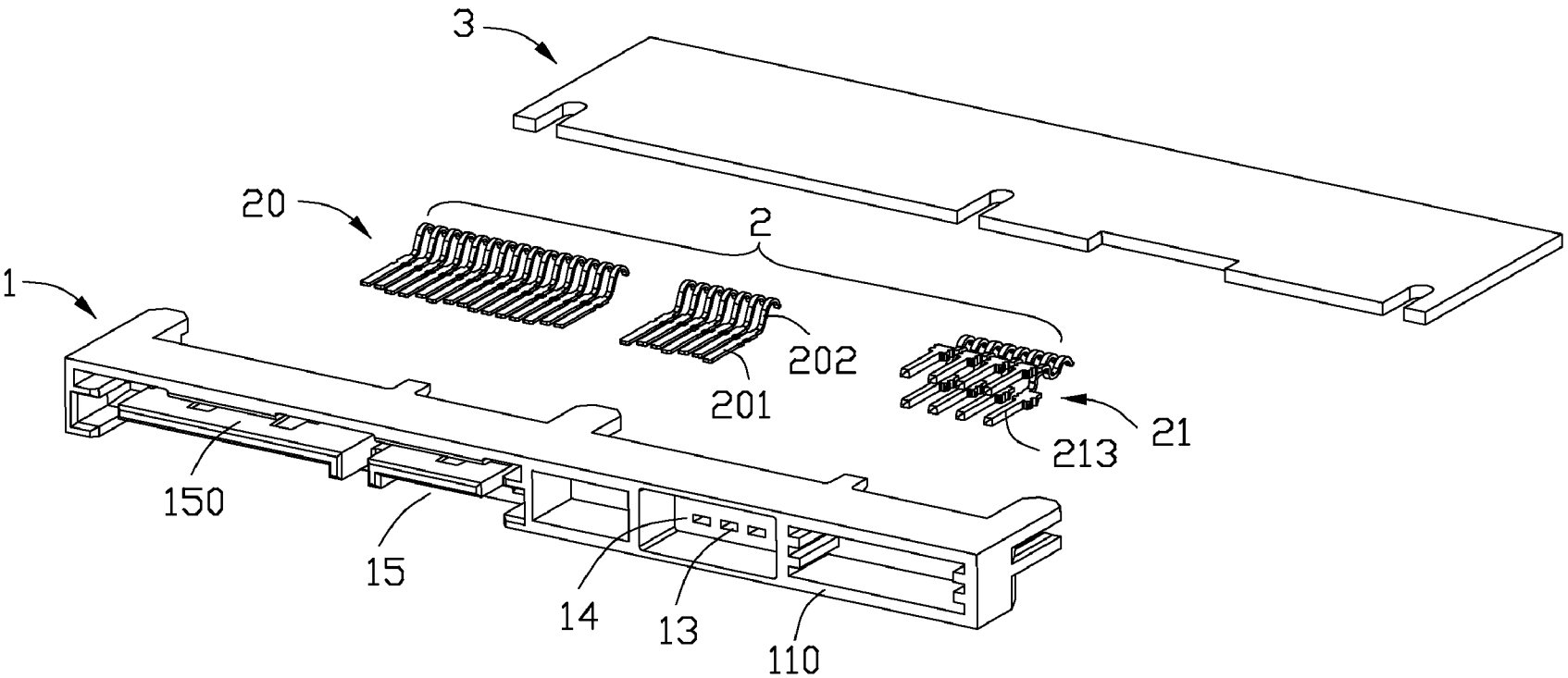
FIG. 3 is an exploded, perspective view of the electrical connector shown in FIG. 1 from another view.

Reference will now be made in detail to the preferred embodiment of the present invention.

Referring to FIGS. 1-4, an electrical connector 100 according to the present invention is adapted for electrically connecting a complementary connector (not shown) and a print circuit board 3. The electrical connector comprises an insulative housing 1 and a plurality of contacts 2 received in the insulative housing 1.

The insulative housing 1 comprises a longitudinal base 10 and a plurality of positioning blocks 16 protruding from a front face 11. Each positioning block 16 has a top portion 160 and a bottom portion 161 with a receiving slot 162 defined therebetween. A connecting portion 163 is defined vertically in the receiving slot 162 and joins with the top and bottom portion 160, 161. The positioning blocks 16 are engaged with the notches on the PCB 31. A pair of protruding portions 12 is defined on the front face 11 between every two adjacent positioning blocks 16. The positioning blocks 16 and the protruding portions 110 are all for retaining the printed circuit board 3 therewith. A first receiving space 14 and a second receiving space 15 arranged side-by-side are defined in a rear face 110 opposite to the front face 11. The second receiving space 15 has a pair of L-shaped tongue boards 150 extending from the inner face of the second receiving space 15. The first and the second receiving space 14, 15 have a plurality of passageways 13 which run through the front face 11 and receive the contacts 2.

The contacts 2 are divided into two groups, one group is signal contacts 20 and the other group is jumper contacts 21. Each signal contact 20 includes a mating portion 201 embedded in the corresponding passageway 13 and an elastic pressing portion 202 extending from the mating portion 201. The jumper contacts 21 are arranged into upper and lower rows. Each jumper contact 21 defines a retention portion 211, a mating portion 213 and a pressing arm 212 extending from two opposite ends of the retention portion 211 reversely. The cross section of the mating portion 213 is a square with a 0.64 mm×0.64 mm in dimension, which is widely accepted in the industry.

Figure 4:
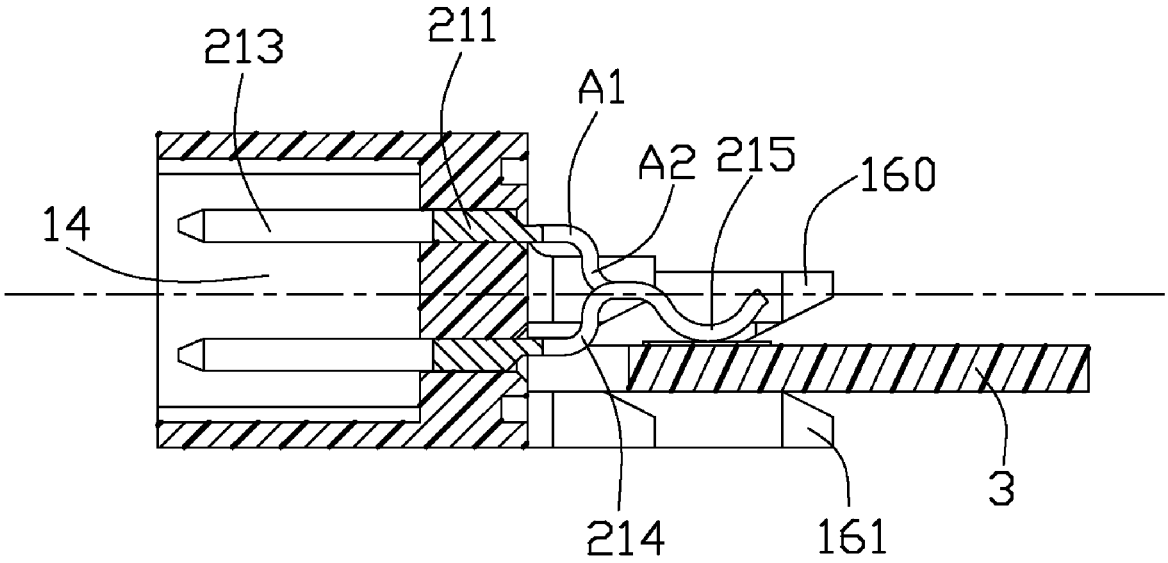
FIG. 4 is a crossing section view of the electrical connector along line 4-4 of FIG. 1.

As best shown in FIG. 4, the retention portion 211 of the upper jumper contact 21 are retained in the base of the housing and are parallel to each other. A central horizontal plane shown in dash line is defined between the retention portions 211 so that the retention portions 211 of the upper row and the lower row are symmetrical about the central horizontal plane. Each pressing arm 212 of the upper and lower jumper contacts 21 has a bending portion 214 to the central plane and a pressing portion 215 further extending from the bending portion 214. Please note the bending portion 214 of contacts of the lower row bends upwards while the bending portion of the upper row bends downwards. The pressing arm 212 is configured as an arc-shape and pushes against the printed circuit board 3 elastically. The pressing arms 212 of all jumper contacts 21 are overlapped seen from the side view along a longitudinal direction.

The manufacturing process of the jumper contacts 21 can save the production cost and time. During the manufacturing process, the jumper contacts 21 are molded by stamping on the same carrier and two bending sections (A1,A2) are defined on each bending portion 214 firstly. The pressing portion 215 are unbent after stamping in the form of a line tail. Then, a set of jumper contacts 21 is inserted into the upper passageways 13 and another set of jumper contacts 21 into the lower passageways 13 inversely so that the bending portions 214 extend reversely and staggered horizontally. After that, the line tails 215 which are arranged side by side along the horizontal direction are crushed into arc-shape by a tool in a same direction downwards to the PCB to form the pressing arm 212. In other words, the upper and lower jumper contacts 21 are manufactured in the same press tool to save mould cost.

Please note the pressing arm 212 of the upper contacts extend adjacent to one side of the retention portion and the pressing arms 212 of the lower contacts extend adjacent to another side of the retention portion. Thus, enough room is provided to set the pressing portion 215 in one row.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing;

an upper row of contacts and a lower row of contacts parallel to each other, each contact comprising a retention portion, a mating portion and a pressing arm extending from two opposite ends of the retention portion, each pressing arm comprising a bending portion and a contact tail extending from and end of the contact tail;

an imaginary central plane defined in the insulative housing about which the mating portions and the retention portions of contacts of the upper row and the lower row are symmetrical;

wherein each pressing arm comprise a bending portion extending to the central plane and a pressing extending from the bending portion, the pressing portions are overlapped seen from a direction along which the contacts are arranged; wherein the pressing arms of contacts of the upper and lower are staggered in the direction; wherein the electrical connector further includes a plurality of second contacts which are received in a second receiving space adjacent to the first receiving space; wherein a pair of L-shaped tongue boards extend outwardly from an inner face of the second receiving space; wherein each second contacts has a contact tail, the contact tails of the first and second contacts push against a printed circuit board elastically.

2. The electrical connector as claimed in claim 1, wherein a first receiving space is defined on the rear face with the mating portions of the contacts received therein.

3. The electrical connector as described in claim 1, wherein positioning blocks protrude from the front face, each positioning block has a top portion and a bottom portion with a receiving slot defined therebetween.

4. The electrical connector as described in claim 3, wherein a connect portion is defined in the receiving slot vertically and joins with the top and bottom portion.

5. An electrical connector for mounting to a printed circuit board, comprising:

an insulative housing defining upper and lower rows of passageways, each passageway defined along a front-to-back direction, and each row defined in a longitudinal direction perpendicular to said front-to-back direction, and a horizontal center line defined between said two rows in a vertical direction perpendicular to both said front-to-back direction and said longitudinal direction;

upper and lower rows of contacts assembled into the corresponding upper and lower rows of passageways, respectively; each of said contacts defining a retaining section disposed in the corresponding passageway, a contacting section extending forwardly from the retaining section, a solder tail extending between the center line and a mounting plane defined by said printed circuit board, and a transition section with a rear end joined with the solder tail and a front end joined with the retaining section; wherein the contacting section, the retaining section and the transition section of the contact in the upper row, is arranged with mirror image with regard to those of the contact in the lower row in a side view, while the solder tail of the contact in the upper row is configured same with that of the contact in the lower row; wherein said plane is located between the center line and a bottom face of the housing in said vertical direction; wherein said plane is located above a middle plane between the center line and the bottom face; wherein the housing further includes a plurality of positioning blocks each including a top portion and the bottom portion to commonly define a receiving slot therebetween in the vertical direction for receiving the printed circuit board therein.

6. The electrical connector as claimed in claim 5, wherein the receiving slot is located at a level similar to that of passageways of the lower row.

* * * * *